US005423715A

United States Patent [19]

Schloetzer

[11] Patent Number: 5,423,715

[45] Date of Patent: Jun. 13, 1995

[54] BOLT-TOGETHER BLAST WHEEL

[75] Inventor: George Schloetzer, Sanford, N.C.

[73] Assignee: The Wheelabrator Corporation, LaGrange, Ga.

[21] Appl. No.: 31,813

[22] Filed: Mar. 15, 1993

[51] Int. Cl.[6] ..... B24C 5/06

[52] U.S. Cl. ..... 451/97; 416/186 R

[58] Field of Search ..... 51/431, 432, 433, 434, 51/435; 451/94, 95, 96, 97, 98; 416/186 R

[56] References Cited

U.S. PATENT DOCUMENTS

| | | | |
|---|---|---|---|
| 1,778,477 | 10/1930 | Wood . | |
| 2,049,466 | 8/1936 | Minich . | |
| 2,204,633 | 6/1940 | Turnbull . | |
| 2,212,451 | 8/1940 | Peik . | |
| 2,241,100 | 5/1941 | Quinn | 51/433 |
| 2,376,639 | 5/1945 | Unger . | |
| 2,508,333 | 5/1950 | Haworth, Jr. et al. . | |
| 3,785,105 | 1/1974 | Freeman . | |
| 3,937,121 | 2/1976 | Schubert . | |
| 4,651,477 | 3/1987 | Brucher | 51/434 |
| 4,662,806 | 5/1987 | Reed . | |
| 4,723,379 | 2/1988 | Macmillian | 51/432 |
| 5,024,028 | 6/1991 | Pierce et al. . | |

*Primary Examiner*—Jack W. Lavinder

*Attorney, Agent, or Firm*—Rockey, Rifkin and Ryther

[57] ABSTRACT

The bolt-together wheel consists of a pair of side plates separated from one another by cylindrical spacers. The spacers are connected to the side plates by shearable bolts where the head of the bolt will shear off when a predetermined torque is applied thereto. The predetermined torque is selected such that the bolt head will shear after the bolt securely fixes the spacers to the side plates. As a result, the bolt does not extend from the side plate such that wear on the blast wheel is reduced. After the bolt head shears, it can be machined to provide a uniform, smooth surface that further minimizes wear. Finally, the edges of the side plates can be provided with tapered faces to reduce the impact force of rebounding shot and the wear resulting therefrom and to direct the rebounding shot away from the interior of the blast wheel.

2 Claims, 2 Drawing Sheets

BOLT-TOGETHER BLAST WHEEL

BACKGROUND OF THE INVENTION

The invention relates, generally, to abrasive blast machines and, more particularly, to an improved bolt-together blast wheel for such machines.

Abrasive blast machines typically consist of a housing rotatably supporting a blast wheel. The blast wheel typically consists of a pair of side plates secured together so as to support a plurality of radially extending blades therebetween as shown in Freeman, U.S. Pat. No. 3,785,105. A drive motor rotates the blast wheel at high speeds and abrasive particles are fed onto the blades as the wheel rotates. The centrifugal force of the rotating wheel propels the abrasive particles from the blades onto a surface being cleaned or otherwise treated.

Because the abrasive particles are relatively small, the blast wheel rotates at high speed and the shot is rebounding from the blades, the surface being cleaned and other components of the blast machine, the abrasive shot undergoes frenetic and uncontrolled movement. As a result, the shot contacts virtually all the interior surfaces of the blast machine. Because abrasive particles consist of small pellets or metal shot or other material they are highly abrasive and cause wear on the components of the blast machine which they contact. The wear is significantly increased in areas where there are projections, depressions, cavities or other non-uniform surfaces because of the abrasive's repeated impact in these areas. Thus, it is desirable to make the surfaces of blast machine components, such as blast wheels, as smooth and uniform as possible.

Because the components of the blast wheel are subject to wear, they must be replaced regularly. It is also desirable, therefore, to make the blast wheel as simply and inexpensively as possible.

Blast wheels such as those illustrated in Freeman, although providing relatively uniform surfaces, are difficult to manufacture because the spacers 16 must be swagged or riveted in place. These manufacturing processes are relatively time consuming and require expensive machinery such as presses. Moreover, swagging requires relatively soft metal because the metal must be deformed during the manufacturing process and, as will be apparent, the use of soft metals results in increased wear. Blast wheels that use bolts, such as Minich, U.S. Pat. No. 2,049,466, are relatively simpler to manufacture. However, the protruding nut and bolt arrangement will increase wear as the abrasive material impacts the exposed surfaces.

Thus, an inexpensive, simple to manufacture, low wear bolt-together blast wheel is desired.

SUMMARY OF THE INVENTION

The bolt-together wheel of the invention overcomes the above-noted shortcomings in the prior art and consists of a pair of side plates separated from one another by cylindrical spacers. The side plates are connected to the spacers by shearable bolts where the head of the bolt will shear off when a predetermined torque is applied thereto thereby ensuring that the proper torque is applied to every bolt. The predetermined torque is selected such that the bolt head will shear after the tapered body of the bolt securely fixes the spacers to the side plates. As a result, the selflocking tapered body of the bolt does not extend from the side plates such that wear on the blast wheel is reduced. Moreover, the selflocking taper of the body of the bolt prevents the loosening of the bolt due to vibration. After the bolt head shears, both the bolt and side plate can be machined to provide an extremely uniform and smooth surface that further minimizes wear. Finally, the edges of the side plates are tapered to reduce the impact force of rebounding shot and the wear resulting therefrom and to direct the rebounding shot away from the interior of the blast wheel.

DETAILED DESCRIPTION OF THE INVENTION

Figure 2:
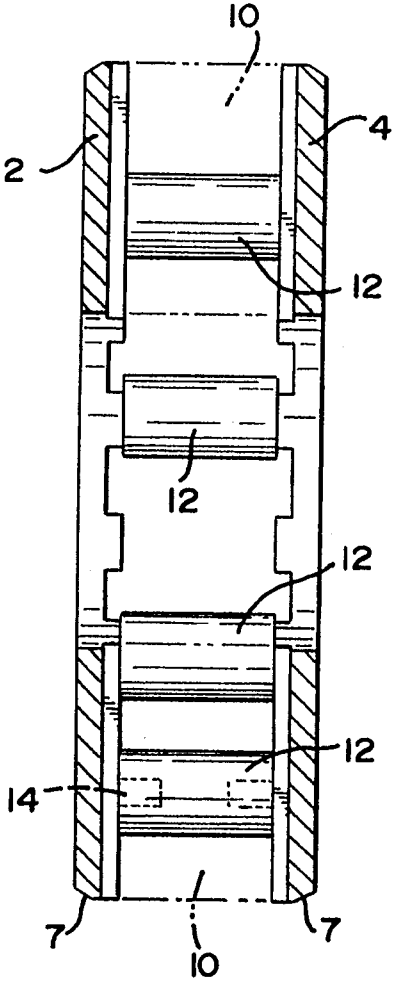
FIG. 2 is a section view taken along line 2—2 of FIG. 1.

Referring more particularly to the figures, the blast wheel of the invention consists of a pair of side plates 2 and 4. The side plates 2 and 4 are identical such that only side plate 2 will be described in detail. Side plate 2 consists of a flat disk constructed of steel or other similar hard material. A centrally located through hole 6 is formed in the side plates 2 for mounting the blast wheel to the rotating shaft of the blast machine. The side plate further includes a plurality of radially extending slots 8 for receiving and retaining the blades 10 of the assembled blast wheel. Finally, the edges of side plate 2 is provided with tapered surface 7. The tapered surface reduces wear on the side plate by reducing the impact force of the abrasive and directs the abrasive away from the interior of the blast wheel and the projected abrasive.

Figure 1:
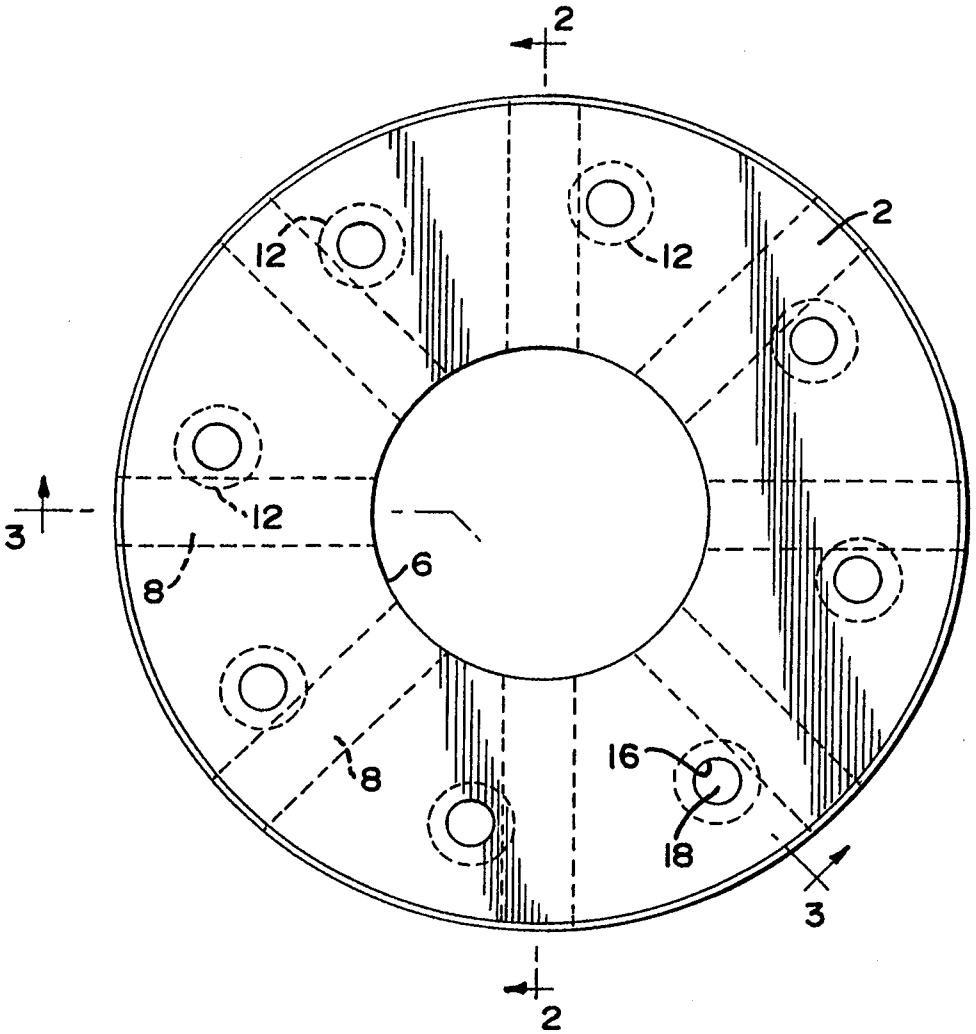
FIG. 1 is a side view of an assembled blast wheel of the invention.
Figure 3:
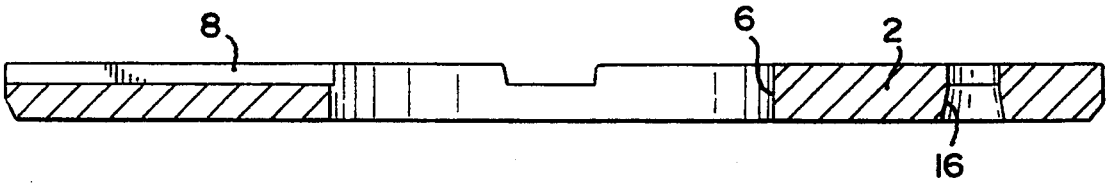
FIG. 3 is a section view of one of the side plates of the invention.

As best shown in FIGS. 1 and 2, a plurality of spacers 12 are disposed between the side plates 2 and 4 having internal screwthreads 14 formed at each end thereof. The spacers 12 are aligned with holes 16 formed in side plates 2 and 4 such that bolts 18 can be inserted through holes 16 to screwthreadably engage screwthreads 14. The bolts, when tightened, fix the side plates 2 and 4 to the spacers 12 and trap the blades 10 therebetween.

Figure 4:
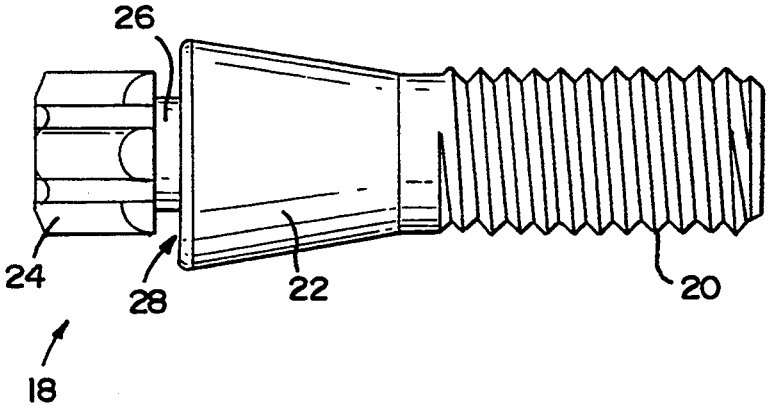
FIG. 4 is a side view of the shearable bolt of the invention.

Referring more particularly to FIG. 4, the bolts 18 consist of a threaded portion 20 for mateably engaging the screwthreads 14 of spacers 12, a tapered body portion 22 that is shaped to tightly fit the selflocking tapered holes 16 and a head 24 that can be engaged by a torque applying tool such as a wrench. The head 24 is connected to body 22 at torque control groove 26 which consists of a relatively narrow cross-sectional area portion of bolt 18.

As the bolt 18 is screwed into spacer 12, the torque required to turn the bolt gradually increases. When the torque reaches a predetermined value, the head 24 will shear from body 22 at groove 24. The value at which the head shears, is selected such that the spacers 12 and side plates 2 and 4 will be securely fixed to one another and the face 28 of body 22 will be substantially flush with the outer surface of the side plates. In the preferred embodiment the bolt shears at approximately 180 ft-lbs of torque. Because the bolts 18 are flush with the outer surface of the side plates 2 and 4 the wear points found in the prior art devices are eliminated.

The outer surfaces of the side plates 2 and 4 and faces 28 of bolts 18 can then be machined to provide a more uniform, smooth surface, if desired. The elimination of the projecting bolts eliminates surfaces for wear to begin and increases the serviceable lifetime of the blast wheel. Moreover, the use of shearable bolts is much cheaper and inexpensive when compared to other flush connections such as rivets or studs. Finally, the use of the shearable bolts eliminates the need for complicated presses and allows the use of harder metals. Moreover, the use of the shearable bolt ensures that the proper torque is applied to every bolt and minimizes the safety problems that can occur if an improperly tightened bolt should back out.

While the invention has been described in some detail with respect to the attached drawings, it will be appreciated that numerous changes in the details and construction of the invention can be made without departing from the spirit and scope of the invention.

What is claimed is:

1. A blast wheel comprising:

(a) a pair of side plates each having a flat substantially uninterrupted outside surface and means for mounting the side plates on a blast machine;

(b) a plurality of spacers disposed between the side plates;

(c) a plurality of bolts screwthreadably engageable with the spacers for securing the side plates to the spacers, said bolts consisting of a body and a head shearable from said body when a predetermined torque is applied to the head as the bolt is threaded into engagement with the spacer such that said body is substantially flush with said side plates, said body and said side plates being machined to create a smooth surface to avoid interruptions on said surface where wear initiation occurs; and (d) a plurality of throwing blades secured between said plates.

2. The blast wheel according to claim 1, wherein said side plates each terminate in an edge, said edge being tapered relative to the outer surface of said side plates to reduce the impact of abrasive particles.

* * * * *